US006041689A

United States Patent [19]

Lair et al.

[11] Patent Number: 6,041,689

[45] **Date of Patent: *Mar. 28, 2000**

[54] VEHICLE ARMORING ASSEMBLY

[76] Inventors: Todd C. Lair; Rick A. Scheer, both of 1330 E. First, Suite 141, Wichita, Kans. 67214

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/948,377

[22] Filed: Oct. 9, 1997

[51] Int. Cl.[7] ..... F41H 7/04

[52] U.S. Cl. ..... 89/36.08; 89/36.02; 296/204

[58] Field of Search ..... 89/36.08, 36.02; 296/203.01, 204, 39.3, 189

[56] References Cited

U.S. PATENT DOCUMENTS

| | | | |
|---|---|---|---|
| 1,273,515 | 7/1918 | Makrenos | 89/36.08 |
| 1,855,734 | 4/1932 | Tarbox | 296/203.01 |
| 4,045,076 | 8/1977 | Day, Sr. et al. | 296/39.3 |
| 4,351,558 | 9/1982 | Mueller | 89/36.08 |
| 5,560,672 | 10/1996 | Lim et al. | 296/189 |
| 5,564,744 | 10/1996 | Frost | 296/189 |

FOREIGN PATENT DOCUMENTS

| | | | |
|---|---|---|---|
| 542351 | 1/1942 | United Kingdom | 89/36.08 |

OTHER PUBLICATIONS

Simula, REMAK Retrofittable Modular Armor Kit, Oct. 18–20, 1993, 2 pages, 89/36.08.

*Primary Examiner*—Stephen M. Johnson
*Attorney, Agent, or Firm*—Kenneth Jack; Davis & Jack, L.L.C.

[57] ABSTRACT

An armoring assembly for a vehicle having a body frame, and having a passenger compartment, the passenger compartment having a roof and a plurality of roof supporting columns, the roof and each roof supporting column having an inwardly facing surface; the armoring assembly consisting of a plurality of interior trim panels, each interior trim panel being fitted for covering the inwardly facing surface of one of the roof supporting columns of the passenger compartment, each interior trim panel having an outer surface and an inner surface, and each interior trim panel consisting of a bullet proof material; and consisting of trim attaching means respectively interconnecting each interior trim panel to the column to which it is fitted, the trim attaching means being capable of holding the interior trim panels in place while bullets fired from a firearm impinge upon their outer surfaces.

16 Claims, 7 Drawing Sheets

VEHICLE ARMORING ASSEMBLY

FIELD OF THE INVENTION

This invention relates to an assembly and method for armoring passenger compartments of passenger carrying vehicles, making them substantially impervious to penetration by small high velocity projectiles. In particular, this invention relates to the armoring of the columnar upper body frame members and roofs of the passenger compartments of passenger carrying vehicles.

BACKGROUND OF THE INVENTION

The passenger compartment of a typical passenger carrying vehicle, such as a four door sedan, consists of a floorboard, a forward fire wall separating the passenger compartment from the engine compartment, a rear fire wall separating the passenger compartment from the trunk and gas tank, four entry doors, four side door windows, a windshield, a rear window, a left and a right roof supporting "A" pillar, a left and a right roof supporting center body pillar, a left and a right roof supporting rear quarter pillar, and a roof. Several of such passenger compartment structural components may be armored without significantly detracting from the appearance and function of the passenger compartment. For example, all of the vehicle's windows may be armored by removing the original manufacturer's equipment (OEM) windows, by installing reveal moldings adapted to accommodate bullet resistant glass having a thickness of approximately one inch, and by installing the bullet resistant glass in place of the OEM windows. Utilization of thick bullet resistant windows does not significantly diminish interior appearance or visibility, and does not significantly reduce space available for passengers in the passenger compartment. The doors of a common four door sedan may similarly be armored by removing OEM water deflectors mounted within the interior spaces of the doors and replacing the water deflectors with bullet resistant or ballistic panels, such panels being molded or formed so that they fit into the space formerly occupied by the water deflectors. Replacement of door water deflectors with ballistic panels has no impact upon the appearance or function of the passenger compartment. The forward and rear fire walls of such a sedan may similarly be armored without detracting from or diminishing the function or appearance of the passenger compartment.

The upper body frame members of a four door sedan (i.e., left and right "A" pillars, the left and right center body pillars, the left and right rear quarter pillars, and the roof) typically present additional impediments to armoring. For example, addition of exterior armor to an "A" pillar detracts from the exterior appearance of the vehicle, and addition of interior armor to such "A" pillar commonly detracts from the interior appearance of the passenger compartment of the vehicle. Also, such "A" pillars typically have insufficient interior space for receiving armoring material; and it is often prohibitively expensive to fabricate a replacement "A" pillar of hardened bullet resistant steel. The roof, center body pillars, and rear quarter pillars of a typical four door sedan present similar obstacles to armoring.

The method and assembly of the present invention offers a novel and inventive solution to such impediments to armoring upper body frame members, providing for ballistic stratification of passenger compartment trims, moldings and head liners with molded laminaes of ballistic fibers.

PRIOR ART PATENTS

U.S. Pat. No. 4,352,316 issued Oct. 5, 1982, to Medlin discloses a lightweight armored vehicle and method of making the same using woven polyester glass protector sheets.

U.S. Pat. No. 5,413,026 issued May 9, 1995, to Madden, Jr., discloses a removable bullet proof shield for use in vehicles.

U.S. Pat. No. 5,438,908 issued Aug. 8, 1995, to Madden, Jr., describes a removable bullet proof apparatus for vehicles.

U.S. Pat. No. 5,517,894 issued May 21, 1996, to Bohn, et al., discloses an explosion proof mat for use in a vehicle.

U.S. Pat. No. 5,531,500 issued Jul. 2, 1996, to Podvin discloses a bullet proof panel for protecting the door of a passenger vehicle.

None of the above disclosed U.S. Patents teaches, discloses or describes the novel, inventive and unique aspects and features of the present invention.

BRIEF SUMMARY OF THE INVENTION

Passenger carrying vehicles in general, including automobiles, station wagons, sport utility vehicles, pickup trucks, vans and limousines may be armored through utilization of the present inventive armoring method and assembly. By way of example, a typical four door sedan is referred to below.

The first step in utilizing the present inventive armoring method and assembly for armoring the exemplary four door sedan, is the removal of the following OEM passenger compartment trim panels: The head liner panel, the left "A" pillar trim panel, the right "A" pillar trim panel, the left center body pillar trim panel, the right center body pillar trim panel, the left quarter trim panel, and the right quarter trim panel. In modern vehicles such OEM trim panels typically consist of injection molded plastic. OEM head liner panels and the OEM trim panels are typically held in place by blind fasteners which extend outwardly from an interior (non-finish) surface of the panel, and which are driven into fastener receiving apertures within the vehicle's upper body frame. Such blind fasteners typically are designed so that, upon application of a sufficient manual pulling force to such a trim panel, the panel disengages without damaging the panel or the frame member.

After removal of the "A" pillar, center body pillar, and quarter pillar trim panels, such panels are either stratified with armoring materials or replaced with armoring materials. A preferred armoring material utilized in the present invention consists of multiple layers of fabric or unidirectional fiber tape, each layer consisting of polyaramid fibers (Kevlar), the multiple layers being impregnated with vinyl ester resin, and the multiple layers being sandwiched between an inner and an outer layer of epoxy resin impregnated fiber glass.

Other fibers suitable for fabrication of the ballistic fabric or tape are: extended chain polyethene fiber, ultra high molecular polyethene fiber, nylon fiber, polyaramid fiber, graphite fiber, semi-crystalline polystyrene fiber, semi-crystalline polyethene fiber, structural glass fiber, electrical glass fiber, and "hybrid" combinations of such fibers in various proportions.

Other sheet materials in addition to, or as an alternative to the fiberglass layers utilizable as additional ballistic strata are aluminum dioxide ceramic, silicone carbide ceramic, and boron carbide ceramic, such ceramics being formed into sheets between 0.05 and 0.25 inches thick.

Other acceptable resins utilizable in fabrication of the ballistic composite material are phenolic resin, polyester resin, rubber compound resins, silicone resins, and thermoplastic resins.

Lamination of the layers of ballistic fabric or tape and fiber glass into a ballistic composite is preferably achieved through an autoclave molding process, exposing the laminae to a temperature of 250 degrees fahrenheit, at a pressure of 60 lbs./sq. inch for approximately 75 minutes. Other acceptable molding processes are vacuum bag molding, heated press molding, and resin transfer molding. The resultant material is a boardlike ballistic composite which, given sufficient layers of ballistic fabric or tape, is substantially impervious to penetration by small high velocity projectiles such as bullets. In order to effectively stop lead bullets fired from a 0.357 caliber handgun (at approximately 1200 feet per second), approximately seventeen layers of, for example, polyaramid fiber are used, resulting in a total ballistic composite thickness of approximately 0.375 inches, including the inner and outer layers of fiberglass. Utilization of such ballistic composite material as a layer stratifying OEM trim panels is advantageous because panel attachment structures of the original equipment panel remain usable for supporting and guiding the blind fasteners.

In order to stop, for example, a lead 0.30 caliber bullet fired from a rifle (at approximately 2500 feet per second), approximately 40 layers of polyaramid fiber fabric or tape are needed, resulting in a ballistic composite thickness of approximately 0.75 inches. Addition of a 0.75 inch thick ballistic composite layer to the interior finished surfaces of interior trim panels typically results in excessive encroachment of armoring material into the interior space of the automobile; detracting from the passenger compartment's aesthetic appearance. Accordingly, where protection from projectiles fired by rifles is desired, it is preferable to reconstruct interior trim panels from ballistic composite materials, rather than utilize the ballistic composite as a layer stratifying OEM trim panels. By eliminating the OEM trim panels, rather than stratifying such panels, the interior finished surfaces of the trim panels extend a lesser distance into the passenger compartment.

In armoring a vehicle's interior trim panel for a handgun level of protection (i.e., where the ballistic composite material is utilized as a stratifying layer over the OEM trim panel) a splash mold may be taken of the interior finished surface of the OEM panel. Such splash mold is utilized to form a positive molding tool reflecting the finished passenger side surface of the OEM panel. The various layers of fiberglass and ballistic composite fabric or tape are laid over the molding tool's outer convex surface. For example, a first layer of fiber glass, then seventeen layers of high molecular polyethylene fiber fabric or tape, and then a second layer of fiber glass are laid over the molding tool, each of the nineteen layers being impregnated with a bonding resin. The entire stratified assembly is then placed inside of a flexible air tight heat resistant bag, air in the bag is evacuated, and the bag containing the assembly is placed inside of an autoclave. The autoclave acts as a pressure cooker applying approximately 60 lbs./sq. inch of pressure at 250 degrees fahrenheit for approximately 75 minutes. Thereafter, the assembly is removed from the bag and the newly created ballistic composite material is removed from the molding tool. After trimming and finishing, the molded ballistic composite armoring layer is bound with an epoxy-based adhesive to the exterior finished surface of the OEM panel. The fiber glass outer layer of the ballistic composite may serve as a finished surface or upholstery may be adhesively applied forming a new finished surface.

Where protection from bullets fired by rifles is needed, (i.e., where original equipment trim panels are not used as a base stratum for the armored trim panel), the molding and fabrication procedure is slightly altered. Instead of fabricating the positive molding tool from a splash mold of the passenger side finished surface of the OEM trim panel, the molding tool may be fabricated from a splash of the interior surface of the trim panel (i.e., the surface of the trim panel opposite the finished passenger side of the panel). Commonly, the interior surface of a trim panel includes plastic support ribs and blind fastener attachment posts. In order for the interior surface of such a trim panel to serve as a mold, such structures are necessarily trimmed away. After fabricating a molding tool reflecting the interior of the original equipment trim panel, fabrication of the molded ballistic composite may proceed in the same manner as described above, with the exception that approximately 40 layers of, for example, woven polyethylene fiber are used, causing the resultant ballistic composite material to have a thickness of approximately 0.75 inches. Thereafter, fastener retaining posts are affixed by an adhesive to the interior surface of the ballistic composite trim panel so that blind fasteners may be supported and aligned identically with the support formerly provided by the OEM trim panel. As in stratified OEM ballistic composite trim panels, the fiber glass exterior surface of the non-stratified ballistic composite trim panel may serve as a finished surface or upholstery may be applied thereto.

The head liner panels of a typical passenger sedan consist of a high density cardboard material having an upholstered side which provides an interior finished surface. Such head liner panels will not adequately serve as a base stratum for supporting stratified molded ballistic head liner. Accordingly, molded ballistic head lining panels preferably are fabricated in the manner described above for rifle level protection whether or not rifle level protection is necessary.

As noted above, the blind fasteners utilized for attaching trim panels to vehicle passenger compartments are commonly designed to disengage upon application of strong manual pulling force to the trim panel. Where a bullet traveling at high velocity strikes the interior surface of an trim panel armored with a molded ballistic composite, forces imparted to the panel typically exceed the force necessary to disengage the panel's blind fasteners. In the event a passenger vehicle so armored is subjected to a barrage of gunfire, the first bullet to strike the interior surface of such a panel may cause the panel to disengage and fall inwardly. Thereafter, bullets may pass relatively unhindered through the formerly armored area. In order to prevent such armoring failures, a network of anchored steel cables is preferably utilized.

Each molded ballistic composite trim panel is preferably secured by steel cables extending from points near each of their blind fastener supporting posts. The attachment point of each steel cable preferably is sufficiently close to a blind fastener to allow the cable to extend through its corresponding fastener receiving aperture within the vehicle's upper body frame. Preferably, blind fasteners, such as push in panel fasteners, having hollow axial channels are utilized for attachment of ballistic composite trim panels so that the steel cables may pass therethrough, extending directly into the fastener receiving apertures. Utilization of such axially channeled fasteners protects cables extending therethrough from sharp edges of the fastener receiving apertures and allows for easier insertion and installation of the fasteners. The steel cables extending from the blind fasteners through a channel within a body frame column are preferably attached to a common anchoring point on a frame member of the vehicle. It is desireable to utilize an anchoring mechanism allowing alternate tensioning and release of the steel cables without cutting the cables. Common threaded eye bolts or hooks may be utilized for tightening and releasing of the steel anchor cables.

Typically, it is not necessary to anchor ballistic composite head liner panels with steel cable because such panels are typically supported by the upper edges of the ballistic composite panels covering the vehicle's roof supporting pillars. Additional layers of fiberglass are preferably added to a ballistic composite head liner for additional rigidity, preventing the head liner from bulging excessively inward upon being struck by bullets.

Accordingly, it is an object of the present invention to provide an assembly and method of armoring the interior passenger space of a passenger carrying vehicle providing armored protection of roof support columns without necessitating addition of armoring material to the outer surfaces of the columns, without necessitating armored replacement of the columns, and without substantially degrading the appearance of the vehicle's passenger compartment.

It is a further object of the present invention to provide an assembly and method for armoring the interior passenger compartment of a passenger carrying vehicle which provides for an armored roof without necessitating addition of armoring material to the exterior surface of the roof, without necessitating replacement of the roof structure, and without substantially degrading the interior appearance of the vehicle's passenger compartment.

It is a further object of the present invention to provide such an assembly and method, further providing molded ballistic composite interior trim panels and head liners consisting of original equipment trim panels stratified with molded ballistic composites.

It is further object of the present invention to provide such an assembly and method further providing steel cable anchoring of molded ballistic composite trim panels.

Other objects, benefits, and advantages of the present invention will become known and apparent to those skilled in the art upon review of the detailed description which follows, and upon review of the drawings appended hereto.

DETAILED DESCRIPTION OF THE PREFERRED EMBODIMENT

Figure 1:
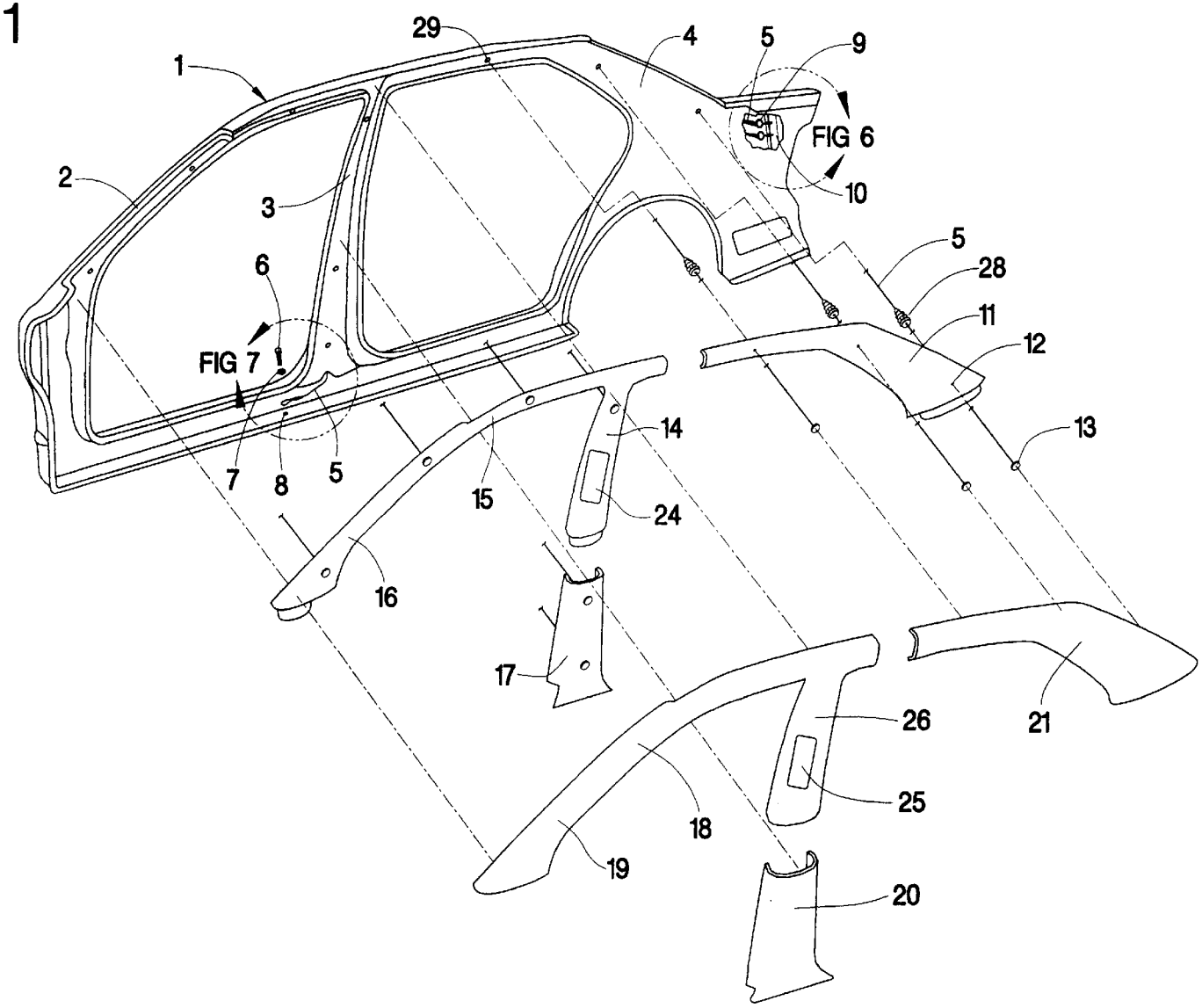
FIG. 1 is an isometric exploded view of right OEM trim panels and right ballistic composite panels, along with a partial view of a passenger vehicle's right upper body frame.

Referring now to the drawings, and in particular to FIG. 1, an exemplary section of a body frame 1 of a common four door sedan is shown. The body frame section 1 has a right roof supporting "A" pillar 2, a right roof supporting center body pillar 3, and a right roof supporting rear quarter pillar 4. An original manufacturer's equipment (OEM) unitary right "A" pillar and upper center body pillar trim panel 15 having a forward "A" pillar section 16 and having a rearward upper center body pillar section 14 is fixedly attached to the body frame 1 so that the right "A" pillar and the right center body pillar are covered. An OEM right rear quarter trim panel 11 and an OEM right lower center body pillar trim panel 17 are similarly attached, covering respectively the right rear quarter pillar 4 and the lower portion of the center body pillar 3. Typically, the OEM trim panels 15, 11, and 17 are composed of injection molded plastic. Blind fasteners 28, preferably "push in" panel fasteners, are a preferred fastening means for interconnecting the OEM trim panels 15, 11, and 17 to the body frame 1, since no portion of a blind fastener is exposed on finished surfaces.

Figure 2:
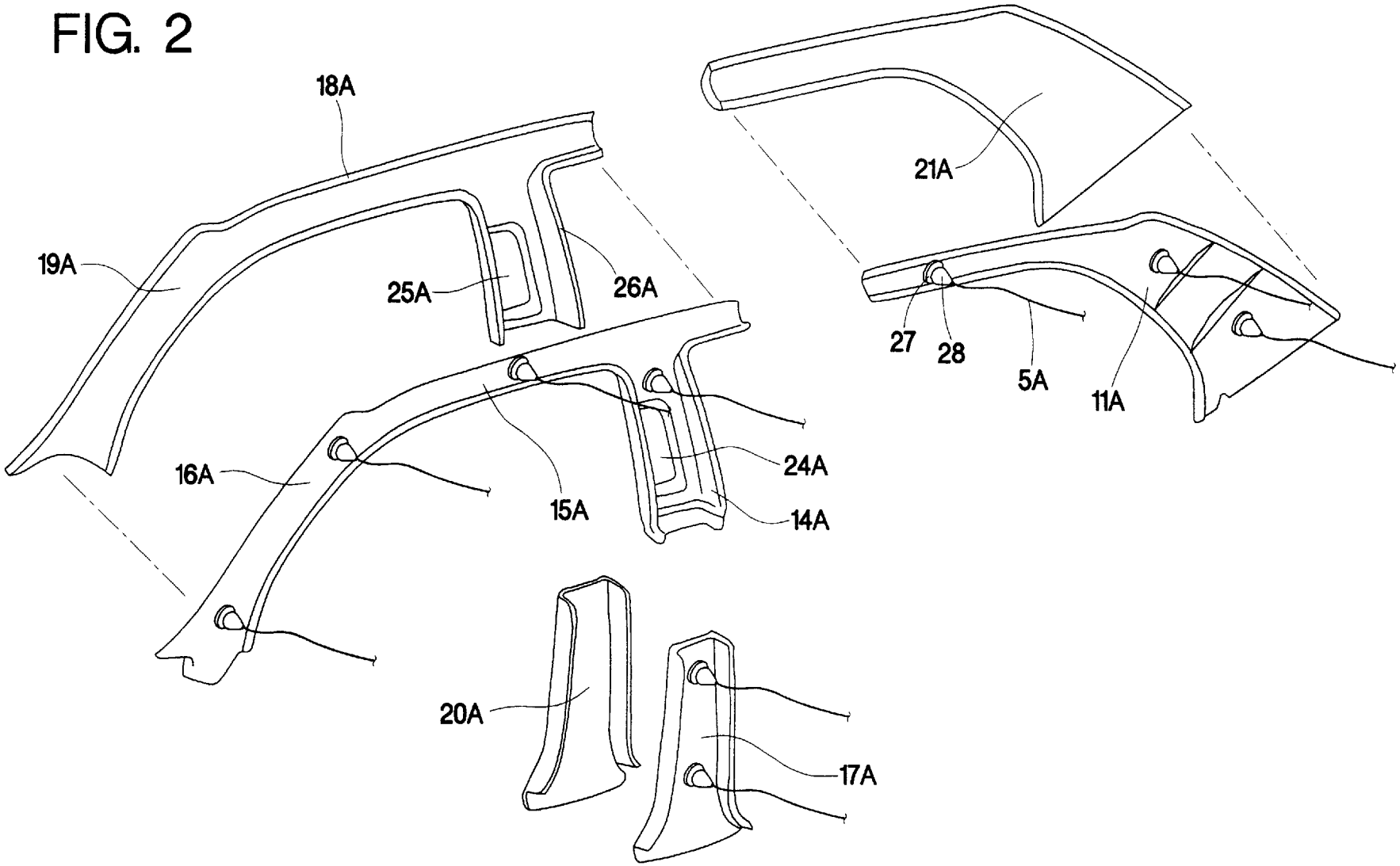
FIG. 2 is an isometric exploded view of left OEM trim panels and left ballistic composite panels.
Figure 7:
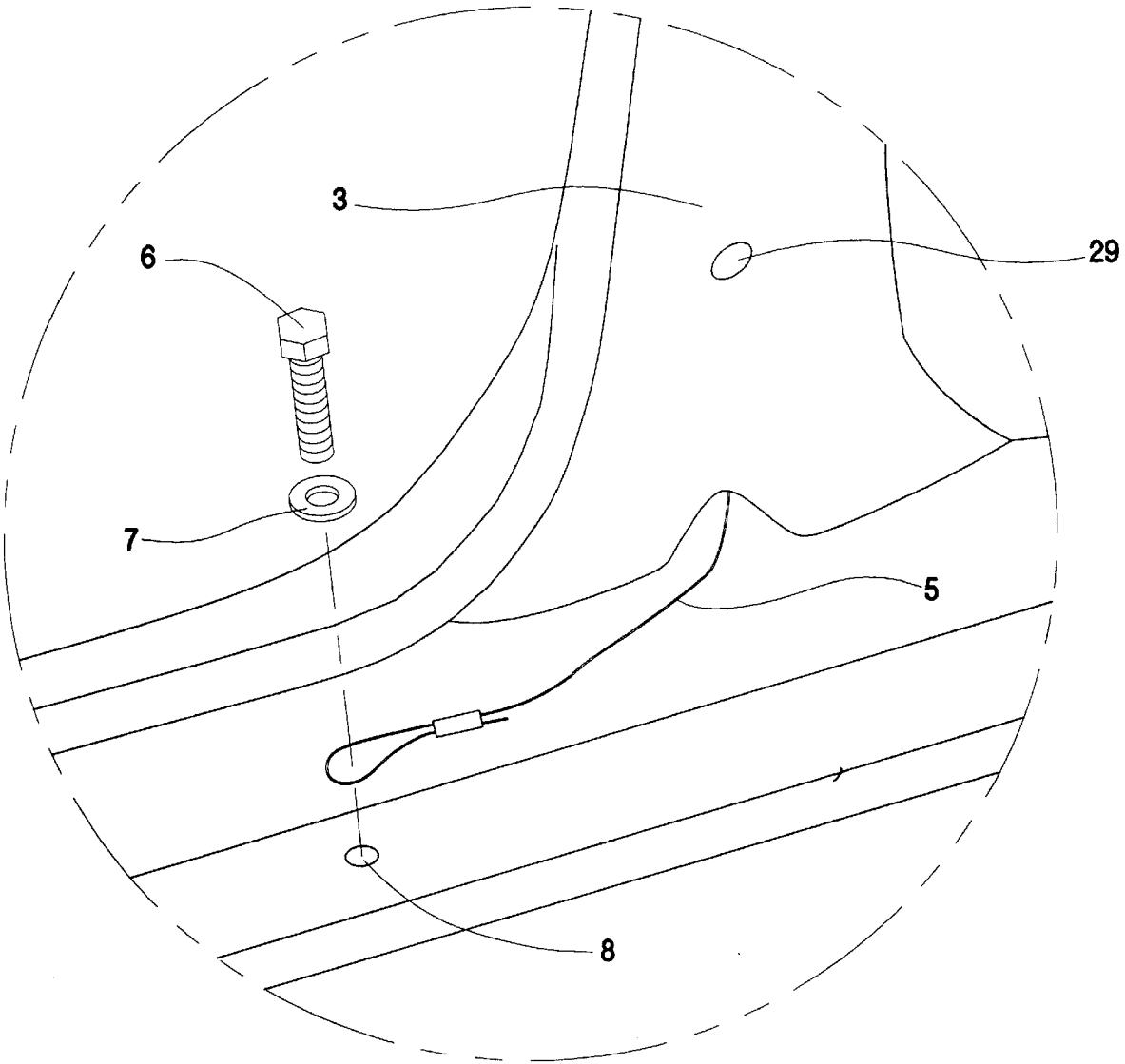
FIG. 7 is a magnified view of another portion of FIG. 1.

Referring to FIG. 2, the blind fasteners 28 are mounted upon the trim panels by, referring to FIG. 7, slotted fastener mounting posts 27 which extend outwardly. Referring again to FIG. 1, the blind fasteners 28 held by such mounting posts also extend outwardly and are driven into fastener receiving apertures 29. Under normal vehicle operating conditions, the blind fasteners securely attach the OEM trim panels 11, 17, and 15 in their proper positions upon the body frame 1.

Referring further to FIG. 1, a unitary right "A" pillar and upper center body pillar ballistic composite 18 having a forward "A" pillar covering section 19 and having a rearward upper center body pillar covering section 26, is fabricated through a molding process, preferably autoclave molding. The ballistic composite 18 is preferably molded so that the inwardly facing finish surface of the OEM unitary right trim panel 15 may nest within the outwardly facing surface of the ballistic composite 18. After fabrication, the OEM unitary right trim panel 15 and the unitary right ballistic composite 18 are nested together and fixedly bonded, preferably by means of an epoxy based adhesive. A right rear quarter ballistic composite 21 and a right lower center body pillar ballistic composite 20, are similarly molded and nestedly bonded to the OEM right rear quarter panel 11 and the OEM right lower center body pillar panel 17.

Referring further to FIG. 1, in the event a bullet traveling at high velocity strikes the exterior surface of the right rear quarter pillar 4, such bullet may penetrate and strike the outwardly facing surface of the OEM rear quarter trim panel 11. Without the armoring effect of the rear quarter ballistic composite 21, such bullet would pass at high velocity into the passenger compartment of the vehicle. Upon adhesive bonding of the rear quarter ballistic composite 21 to the OEM rear quarter trim panel 11, such bullet ceases penetration of materials at the ballistic composite layer. However, forces applied by such bullet to the rear quarter ballistic composite 21 are necessarily transferred to the blind fasteners 28, potentially driving the entire trim panel/composite assembly into the passenger compartment. To prevent the force of bullets from disengaging the blind fasteners 28 from their fastener receiving apertures 29, each of the OEM trim panels 15, 11 and 17 preferably are anchored by auxiliary steel anchor cables 5.

Figure 5:
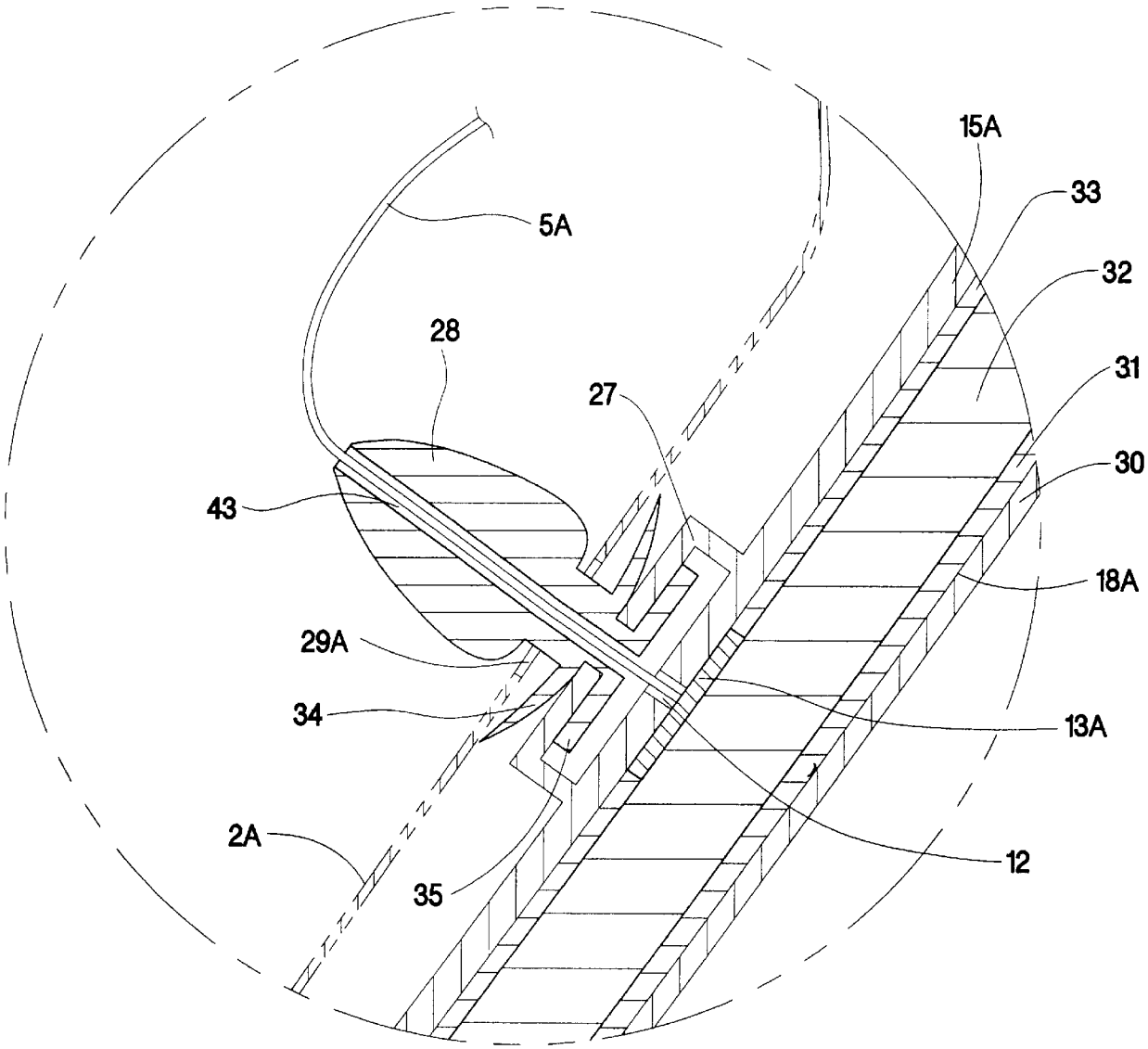
FIG. 5 is a magnified view of a portion of FIG. 4.
Figure 6:
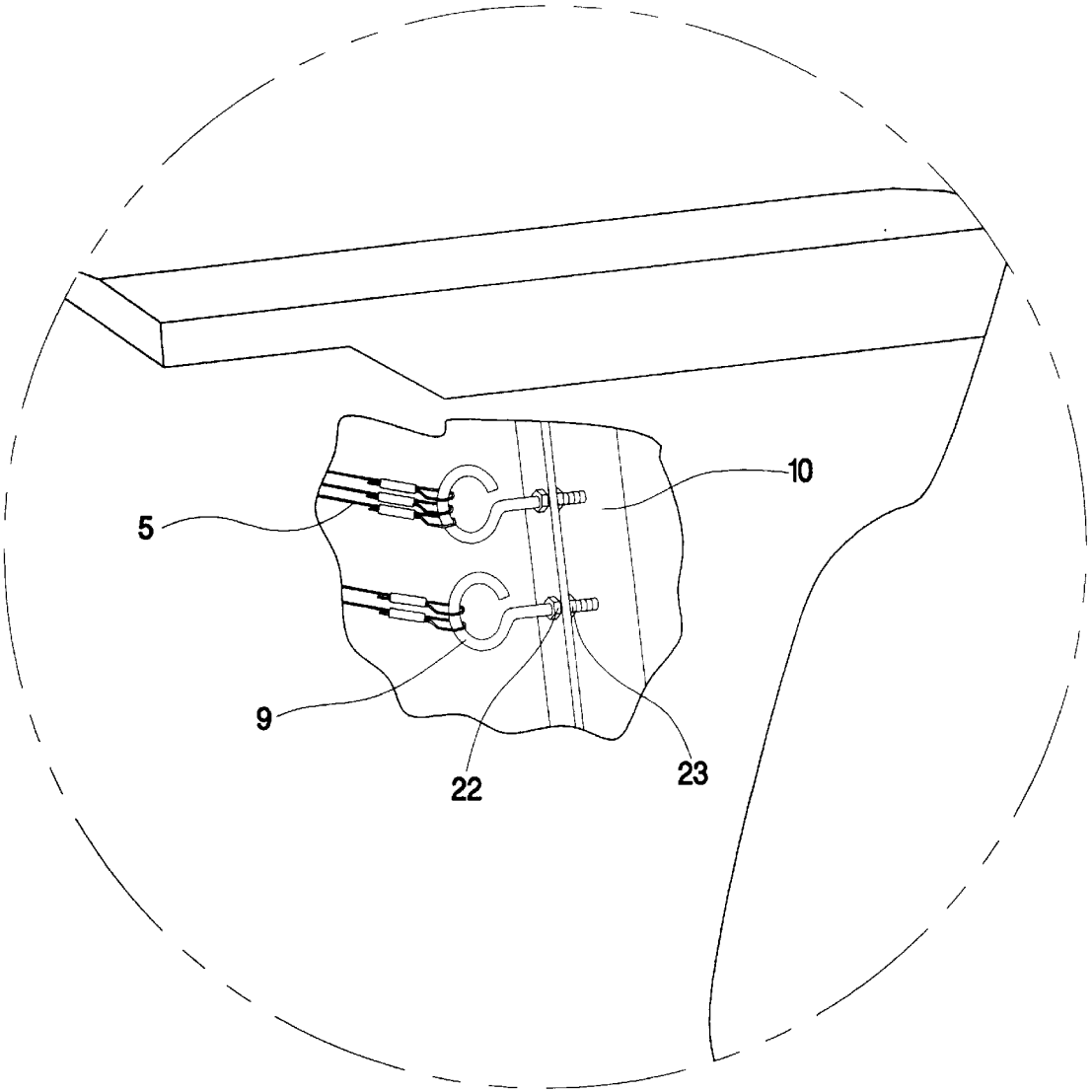
FIG. 6 is a magnified view of a portion of FIG. 1.

Referring to FIG. 5, each steel anchor cable 5 has a first end fixedly attached to a steel disc 13, the steel discs 13 being nested between a layer of ballistic composite material 32 and the inwardly facing surface of the OEM trim panel to which the ballistic composite is attached. From the steel discs 13, the steel cables 5 extend outwardly through, referring to FIG. 1, cable receiving apertures 12 within the OEM trim panels. Referring to FIG. 5, the steel cables then extend through channels 43 which extend axially through the blind fasteners 28. Referring to FIG. 1, the steel cables 5 then extend through the fastener receiving apertures 29, and further extend from those points along interior channels within the body frame 1. Referring to FIG. 6, the opposite ends of the steel cables 5 are looped and are anchored to a convenient structural frame member 10 by means of eye bolts 9. Through manipulation of threaded nuts 22 and 23, the steel cables 5 may be alternately released and tightened. Alternately, referring to FIG. 7, the steel cables 5 may be anchored by means of threaded bolts 6 extending into a threaded bolt receiving apertures 8, the heads of the bolts 6 pressing washers 7 downward against the looped ends of the steel cables 5. Referring to FIG. 5, utilization of the steel anchor cables 5 in conjunction with the blind fasteners 28 provides dual attaching means. The fastener supporting posts 27 in combination with the blind fastener heads 35 and the blind fastener collars 35 sufficiently serve as an attaching means under normal operating conditions. The combination of the nested steel discs 13 and the steel anchor cables 5 sufficiently serves as an attaching means under extreme circumstances where bullets strike the outwardly facing surfaces of the trim panels.

Referring to FIG. 1, the right OEM unitary panel 15 and the right unitary ballistic composite 18 respectively have shoulder belt ports 24 and 25. Armoring of such shoulder belt ports 24 and 25 may be accomplished through the placement of a separate ballistic composite shield (not shown) between the center body pillar 3 and the outwardly facing surface of the upper center body pillar section 14.

Figure 3:
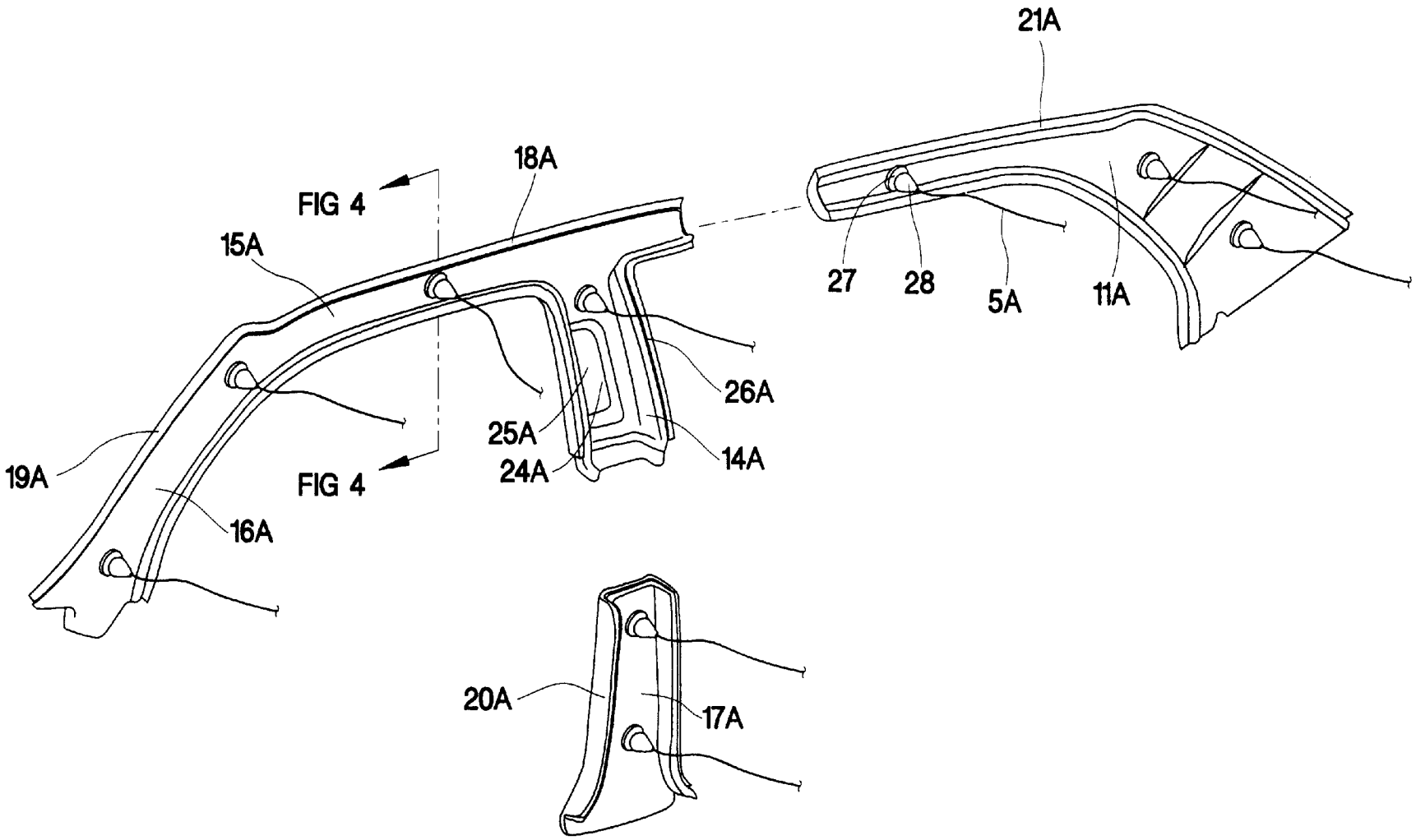
FIG. 3 is an isometric view of left OEM trim panels having attached left ballistic composite panels.
Figure 4:
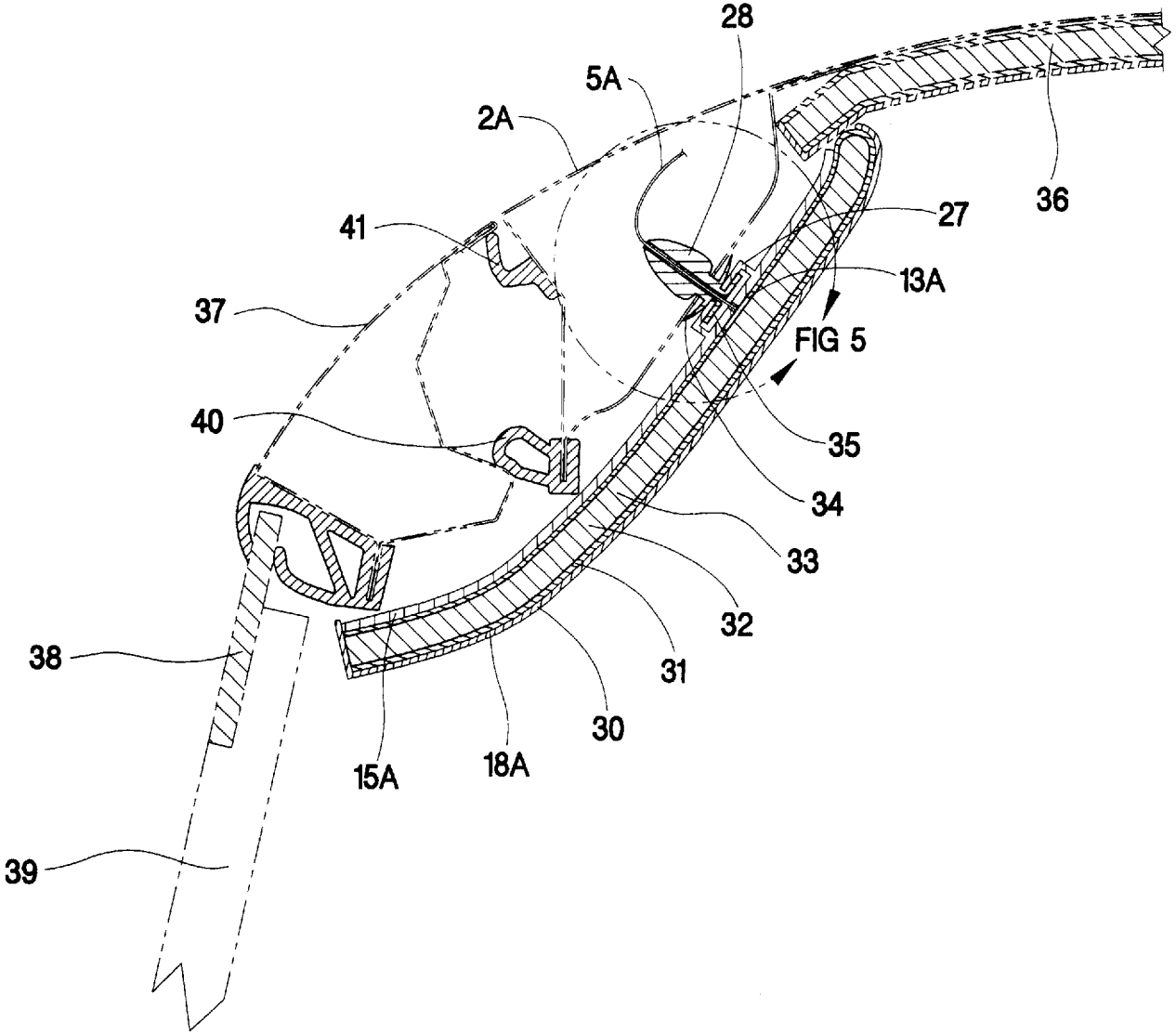
FIG. 4 is a sectional view of a right "A" pillar OEM trim panel with attached ballistic composite.

FIGS. 2 and 3 depict exploded and assembled views of left OEM trim panels and left ballistic composites. Drawing elements 11A, 15A, 16A, 17A, 18A, 19A, 20A, 21A, 24A, 25A, and 26A represent components installable upon the left side of the exemplary passenger sedan, such components mirroring drawing elements 11, 15, 16, 17, 18, 19, 20, 21, 24, 25, and 26 of drawing FIG. 1. FIG. 4 depicts a sectional view of the left OEM unitary trim panel 15A, such panel being nested within and adhesively attached to a left unitary ballistic composite 18A. In the view, a left bullet resistant window 39, a steel window flange 38, a reveal molding 42, an upper door frame 37 with rubber seals 40 and 41, a left "A" pillar 2A, and a ballistic composite head liner 36 are shown in ghost. The sectional plane of FIG. 4 passes axially through a fastener attachment post 27 and through a blind fastener 28.

The view of FIG. 4 explains how the left unitary ballistic composite 18A acts in combination with a bullet proof window 39 and with the ballistic composite head lining panel 36, to provide a continuous zone of protection. Bullets which strike at or below the upper periphery of the steel flange 38 of the bulletproof window 39 are stopped by those armoring elements. Above the steel flange 38, bullets may either strike and pass through the reveal molding 42, through the window frame 37, or through the "A" pillar 2A. Bullets passing through any of these zones necessarily impinge upon and are stopped by the left unitary ballistic composite 18A, the steel anchor cables preventing the ballistic composite from dislodging inwardly. The overlap of the ballistic composite head liner panel 36 and the left unitary ballistic composite 18A completes a continuous zone of protection.

Referring to FIG. 5, the left unitary ballistic composite 18A (along with all other ballistic composite trim panels) preferably is composed of multiple layers of a suitable ballistic fiber fabric or tape 32 such as polyaramid fabric or tape; such fabric or tape being impregnated with a suitable polymer or rubber based resin. The ballistic fiber layer 32 is preferably nested between inner and outer layers of fiberglass 31 and 33. The outer layer of fiberglass 31 may serve as an interior finish surface, or such layer may be covered by a layer of finishing upholstery 30.

Referring to FIG. 5, the thickness of the plastic OEM trim panel 15A along with the plastic fastener support posts 27 extend the ballistic composite 18A inwardly. When such OEM trim panels are utilized, additional layers of ballistic composite material 32 necessarily further extend the finished surface of the ballistic composite inwardly. Where protection from very high velocity projectiles is desired, additional layers of ballistic composite materials is necessary, resulting in an armor thickness which may undesirably encroach into passenger space. Such encroachment may be mitigated through elimination of the OEM trim panels. Elimination of the OEM trim panels allows the space formerly occupied by such panel to be filled with armoring material, and allows additional ballistic composite layers to extend the armoring thickness both inwardly and outwardly. Where OEM trim panels are eliminated, assemblies are similar to those depicted in FIGS. 1–7 except, referring to FIG. 5, the fastener supporting posts 27 are separate elements which are adhesively attached to or molded as part of the outwardly facing surfaces of the ballistic composites.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. An armoring assembly for a vehicle having a body frame, and having a passenger compartment, the passenger compartment having a roof and a plurality of roof supporting columns, the roof and each roof supporting column having an inwardly facing surface; the armoring assembly comprising:

(a) a plurality of interior trim panels, each interior trim panel being fitted for covering the inwardly facing surface of one of the roof supporting columns of the passenger compartment of the vehicle, each interior trim panel having an outer surface and an inner surface, each interior trim panel comprising a stratified lamina of ballistic fabric; and, (b) trim attaching means respectively interconnecting each interior trim panel and the column to which it is fitted, the trim attaching means being capable of holding the interior trim panels in place while bullets fired from firearms impinge upon their outer surfaces.

2. An armoring assembly for a vehicle having a body frame, and having a passenger compartment, the passenger compartment having a roof and a plurality of roof supporting columns, the roof and each roof supporting column having an inwardly facing surface; the armoring assembly comprising:

(a) a plurality of interior trim panels, each interior trim panel being fitted for covering the inwardly facing surface of one of the roof supporting columns of the passenger compartment of the vehicle, each interior trim panel having an outer surface and an inner surface, each interior trim panel comprising a bullet resistant armoring material; and, (b) trim attaching means respectively interconnecting each interior trim panel and the column to which it is fitted, the trim attaching means being capable of holding the interior trim panels in place while bullets fired from firearms impinge upon their outer surfaces;

(c) an interior trim head liner having an inner surface and an outer surface, the interior trim head liner being fitted for covering the inwardly facing surface of the roof of the vehicle, the interior trim head liner comprising a bullet resistant armoring material; and, (d) head liner attaching means interconnecting the roof and the interior trim head liner, the head liner attaching means being capable of holding the interior trim head liner in place while bullets fired from the firearm impinge upon its outer surface.

3. An armoring assembly for a vehicle having a body frame, and having a passenger compartment, the passenger compartment having a roof and a plurality of roof supporting columns, the roof and each roof supporting column having an inwardly facing surface; the armoring assembly comprising:

(a) a plurality of interior trim panels, each interior trim panel being fitted for covering the inwardly facing surface of one of the roof supporting columns of the passenger compartment of the vehicle, each interior trim panel having an outer surface and an inner surface, each interior trim panel comprising a bullet resistant armoring material;

(b) trim attaching means respectively interconnecting each interior trim panel to the column to which it is fitted, the trim attaching means being capable of holding the interior trim panels in place while bullets fired from firearms impinge upon their outer surfaces;

(c) an interior trim head liner having an inner surface and an outer surface, the interior trim head liner being fitted for covering the inwardly facing surface of the roof of the vehicle, and the interior trim head liner comprising of a bullet resistant armoring material; and (d) head liner attaching means interconnecting the roof and the interior trim head liner, the head liner attaching means being capable of holding the interior trim head liner in place while bullets fired from the firearm impinge upon its outer surface; the bullet resistant armoring material of said interior trim panels comprising molded lamina of fibers selected from the group of polyethylene fiber, polyaramid fiber, nylon fiber, graphite fiber, semi-crystalline polystyrene fiber, semi-crystalline polyethylene fiber, aromatic polyamide fiber, structural glass fiber, or electrical glass fiber, the bullet resistant armoring material of the interior trim head liner comprising molded lamina of fibers selected from the group of polyethylene fiber, polyaramid fiber, nylon fiber, graphite fiber, semi-crystalline polystyrene fiber, semi-crystalline polyethylene fiber, aromatic polyamide fiber, structural glass fiber, or electrical glass fiber.

4. The armoring assembly of claim No. 3 wherein the trim attaching means comprises a plurality of steel cables, an end of each steel cable being fixedly attached to and extending outwardly from the outer surface of one of the interior trim panels, the opposite end of each steel cable being fixedly attached to the body frame of the vehicle.

5. The armoring assembly of claim No. 4, wherein the trim attaching means further comprises a plurality of blind fasteners, each blind fastener having a head and a point, the head of each blind fastener being mounted upon and extending outwardly from the outer surface of one of the interior trim panels, each blind fastener being adapted for engagement with a fastener receiving aperture within the body frame of the vehicle.

6. The armoring assembly of claim No. 3, wherein a plurality of the interior trim panels are stratified, each stratified interior trim panel having a stratum comprising the molded laminae of ballistic fibers, each stratified interior trim panel having a second stratum extending outwardly from the outer surface of the molded laminae of ballistic fibers, each second stratum comprising a layer of injection molded plastic.

7. The armoring assembly of claim No. 6, wherein the trim attaching means comprises a plurality of steel cables, the first end of each steel cable being fixedly attached to and extending outwardly from the outer surface of one of the interior trim panels, the second end of each steel cable being fixedly attached to the body frame of the vehicle.

8. The armoring assembly of claim No. 7, wherein the attaching means further comprises a plurality of blind fasteners, each blind fastener having a head and a point, the head of each blind fastener being mounted upon and extending outwardly from the outer surface of one of the interior trim panels, each blind fastener being adapted for engagement with a plurality of fastener receiving apertures within the body frame of the vehicle; wherein, the attachment of the first end of each steel cable is in close proximity with a blind fastener; and wherein each steel cable extends from such attachment through one of the fastener receiving apertures within the body frame.

9. An armoring assembly for a vehicle having body frame, and having a passenger compartment, the passenger compartment having a roof and a plurality of roof supporting columns, the roof and each roof supporting column having an inwardly facing surface; the armoring assembly comprising:

(a) a plurality of interior trim panels, each interior trim panel being fitted for covering the inwardly facing surface of one of the roof supporting columns of the passenger compartment of the vehicle, each interior trim panel having an outer surface and an inner surface, each interior trim panel comprising a stratified lamina of bullet resistant armoring material; and, (b) trim attaching means respectively interconnecting each interior trim panel and the column to which it is fitted, the trim attaching means being capable of holding the interior trim panels in place while bullets fired from firearms impinge upon their outer surfaces; the stratified lamina of bullet resistant armoring material of the interior trim panels comprising fibers selected from the group of polyethylene fiber, polyaramid fiber, nylon fiber, graphite fiber, semi-crystalline polystyrene fiber, semi-crystalline polyethylene fiber, aromatic polyamide fiber, or glass fiber.

10. The armoring assembly of claim 9 wherein the trim attaching means comprises a plurality of steel cables, an end of each steel cable being fixedly attached to and extending outwardly from the outer surface of one of the interior trim panels, the opposite end of each steel cable being fixedly attached to the body frame of the vehicle.

11. The armoring assembly of claim 10 wherein the trim attaching means further comprises a plurality of blind fasteners, each blind fastener having a head and a point, the head of each blind fastener being mounted upon and extending outwardly from the outer surface of one of the interior trim panels, each blind fastener being adapted for engagement with a fastener receiving aperture within the body frame of the vehicle.

12. The armoring assembly of claim 11 wherein a plurality of the interior trim panels are further stratified with an injection molded plastic stratum extending outwardly from the stratified lamina of bullet resisting armoring material.

13. An armoring assembly for a vehicle having a body frame, and having a passenger compartment, the passenger compartment having a roof and a plurality of roof supporting columns, the roof and each roof supporting column having an inwardly facing surface; the armoring assembly comprising:

(a) a plurality of interior trim panels, each interior trim panel being fitted for covering the inwardly facing surface of one of the roof supporting columns of the passenger compartment of the vehicle, each interior trim panel having an outer surface and an inner surface, each interior trim panel comprising a bullet resistant armoring material; the bullet resistant armoring material comprising a molded lamina of fibers selected from the group of polyethylene fiber, polyaramid fiber, nylon fiber, graphite fiber, semi-crystalline polystyrene fiber, semi-crystalline polyethylene fiber, aromatic polyamide fiber, or glass fiber; and, (b) trim attaching means respectively interconnecting each interior trim panel to the column to which it is fitted, the trim attaching means being capable of holding the interior trim panels in place while bullets fired from firearms impinge upon their outer surfaces.

14. The armoring assembly of claim 12 wherein the trim attaching means comprises a plurality of steel cables, an end of each steel cable being fixedly attached to and extending outwardly from the outer surface of one of the interior trim panels, the opposite end of each steel cable being fixedly attached to the body frame of the vehicle.

15. The armoring assembly of claim 14 wherein the trim attaching means further comprises a plurality of blind fasteners, each blind fastener having a head and a point, the head of each blind fastener being mounted upon and extending outwardly from the outer surface of one of the interior trim panels, each blind fastener being adapted for engagement with a fastener receiving aperture within the body frame of the vehicle.

16. The armoring assembly of claim 15 wherein a plurality of the interior trim panels have an injection molded plastic stratum extending outwardly from the molded lamina of fibers.

* * * * *